United States Patent [19]

Surkamp et al.

[11] Patent Number: 4,921,179

[45] Date of Patent: May 1, 1990

[54] METHOD AND APPARATUS FOR POSITIONING A YARN END FOR UNWINDING

[75] Inventors: Paul Surkamp, Kempen; Ulrich Wirtz, Monchen-Gladbach, both of Fed. Rep. of Germany

[73] Assignee: W. Schlafhorst & Co., Fed. Rep. of Germany

[21] Appl. No.: 371,373

[22] Filed: Jun. 26, 1989

[30] Foreign Application Priority Data

Jun. 24, 1988 [DE] Fed. Rep. of Germany ..... 3821343

[51] Int. Cl.[5] ..... B65H 54/00; B65H 67/08

[52] U.S. Cl. ..... 242/18 R; 242/35.6 E

[58] Field of Search ..... 242/18 R, 35.6 E, 35.6 R, 242/18 EW, 35.5 R, 35.5 A

[56] References Cited

U.S. PATENT DOCUMENTS

| | | | |
|---|---|---|---|
| 3,236,464 | 2/1966 | Wey | 242/35.63 E X |
| 3,608,843 | 9/1971 | Siedlich | 242/35.6 E |
| 4,009,840 | 3/1977 | Muller | 242/35.6 E |
| 4,634,065 | 1/1987 | Kupper et al. | 242/18 R |
| 4,798,348 | 1/1989 | Matsui et al. | 242/35.6 E |
| 4,824,037 | 4/1989 | Haberkorn | 242/35.6 E |
| 4,842,206 | 6/1989 | Kawasaki et al. | 242/18 R |

FOREIGN PATENT DOCUMENTS

| | | |
|---|---|---|
| 3338857 | 5/1984 | Fed. Rep. of Germany . |
| 3244378 | 8/1984 | Fed. Rep. of Germany . |
| 3630836 | 3/1987 | Fed. Rep. of Germany . |
| 411648 | 11/1966 | Switzerland . |

*Primary Examiner*—Stanley N. Gilreath

*Attorney, Agent, or Firm*—Shefte, Pinckney & Sawyer

[57] ABSTRACT

A yarn end unwinding apparatus includes a support base for supporting a yarn package in an upright disposition and a cooperating member. The cooperating member at least partially circumferentially surrounds the upright yarn package and includes a plurality of jet nozzles for directing jet streams of gas interiorly of the cooperating member. The jet streams of gas combine together to form a spiraling stream of gas which causes planetary motion of the package. The package moves in contacting relation along the inner surface of the cooperating member while simultaneously rotating about the package axis and this planetary motion of the package causes unwinding of the yarn end therefrom into position for subsequent package unwinding engagement. The support base preferably includes a pair of relatively movable semi-cylindrical portions.

38 Claims, 3 Drawing Sheets

METHOD AND APPARATUS FOR POSITIONING A YARN END FOR UNWINDING

BACKGROUND OF THE INVENTION

The present invention relates to a method and apparatus for unwinding a yarn end of a yarn package into position for subsequent package unwinding engagement.

In Swiss Patent No. 411,648, a method and apparatus is disclosed for locating and engaging a yarn end of a yarn package for positioning the yarn end for subsequent package unwinding engagement. The yarn package is disposed in a cylindrical chamber and streams of air are directed in inclined directions with respect to the package to cause unwinding of the yarn end from the yarn package. These streams of air are inclined upwardly with respect to the package to urge the yarn end upwardly from the package through the top of the cylindrical chamber to a yarn end engaging device positioned above the package in the cylindrical chamber.

However, the need still exists for an apparatus which unwinds a yarn end into position for subsequent package unwinding engagement at a faster rate than the known yarn end unwinding devices so that the yarn end unwinding operation can be optimized.

SUMMARY OF THE INVENTION

The present invention provides a method and apparatus for unwinding the yarn end of a yarn package at a relatively fast rate, thus decreasing the cycle time for each unwinding operation and optimizing the yarn end unwinding operation.

The present invention provides a method and apparatus for unwinding a yarn end of a yarn package of the type having yarn wound on a tube and having an axis. The method includes supporting the package in contact with a cooperating member, the cooperating member at least partially surrounding the package and the package being supported to permit rotation about its axis and moving the package in contact with the cooperating member in a planetary movement while directing a stream of gas in a spiraling direction to the package during the planetary movement of the package, thereby unwinding the yarn end from the package into position for subsequent package unwinding engagement. The stream of gas preferably causes the orbital movement of the package during its planetary movement, the axial rotation of the package in its planetary motion or the planetary motion of the package.

According to one preferred embodiment of the method of the present invention, the method includes disposing the unwound yarn end in the package tube. According to another preferred embodiment of the method of the present invention, the method further includes supporting the package in non-contacting adjacent relation to the cooperating member after the yarn end has been unwound into the position for subsequent package unwinding engagement and during subsequent package unwinding. In accordance with the present invention, the method includes, in the event of a yarn break being present is supported the in non-contacting adjacent relation to the cooperating member, further supporting the package in contact with the cooperating member and moving the package in contact with the cooperating member in a planetary motion to position another yarn end for subsequent package unwinding engagement.

According to yet another preferred embodiment of the method of the present invention, in the event of a yarn break during the unwinding of the yarn end into position for subsequent unwinding engagement, the method includes further moving the package in contact with the cooperating member in a planetary motion while directing a stream of gas in a spiraling direction relative to the package during the planetary movement of the package to thereby further unwind the yarn end from the package into position for subsequent package unwinding engagement.

According to a further embodiment of the method of the present invention, the method further includes applying a suction through the tube to draw the yarn end into the tube in position therein for subsequent package unwinding engagement.

The present invention also provides an apparatus for unwinding a yarn end of a yarn package of the type having yarn wound on a tube and having an axis. The apparatus includes a cooperating member at least partially circumferentially surrounding the package, support means for supporting the package in contact with the cooperating member, the support means permitting the package to rotate about its axis, and means for moving the package. The means for moving the package moves the package in contact with the cooperating member in a planetary motion, and includes means for directing a stream of gas in a spiraling direction relative to the package sufficient to unwind the yarn end, whereby the yarn end is unwound from the package into position for subsequent package unwinding engagement. In accordance with the present invention, the gas directing means may cause the orbital movement of the package during its planetary movement, the axial rotation of the package during its planetary movement or both the orbital movement and the axial rotation of the package during its planetary movement.

According to one preferred embodiment of the apparatus of the present invention, the cooperating member includes a tube which completely surrounds the package.

According to one aspect of the apparatus of the present invention, the support means supports the package in non-contacting adjacent relation to the cooperating member after the yarn end has been unwound into the position for subsequent package unwinding engagement and during subsequent package unwinding.

According to a further embodiment of the apparatus of the present invention, the apparatus means for applying a suction through the package tube to draw the yarn end into the package tube. According to yet another embodiment of the apparatus of the present invention, the gas directing means includes a plurality of jet nozzles mounted in the cooperating member for directing jet streams of gas interiorly of the cooperating member in inclined tangential directions with respect to the package toward an end of the package, whereby the jet streams of gas combined together to form the spiraling streams of gas.

Preferably, the support means yieldably supports the package in generally vertical disposition in non-contacting relation in generally vertical disposition in non-contacting relation to the cooperating member while allowing the package to be moved into cooperating member contact by the gas directing means with the package tube aligned along a vertical axis, the cooperating member being disposed generally coaxial with the vertical axis of the package and the jet nozzles extending inwardly of the cooperating member at upward inclinations. The cooperating member is preferably a tube disposed for completely circumferentially surrounding the package.

According to yet a further embodiment of the apparatus of the present invention, the cooperating member is cylindrical in shape. According to another embodiment of the apparatus of the present invention, the cooperating member is conical in shape. Preferably, the cooperating member tapers inwardly with respect to the axis of the package in the direction from the top to the bottom of the package.

According to another embodiment of the apparatus of the present invention, the support means includes a plate portion engageable by a transport device for transport thereby and a post extending from the plate portion for package supporting insertion in the package tube. The support means preferably includes a base member having a non-plate surface and the plate portion is disposed on the non-planar surface for relative movement thereon, whereby the relative movement of the plate portion and the non-planar surface permits orbital movement of the package during its planetary motion. According to one aspect of the present invention, the non-planar surface of the base member is a convex surface on which the plate portion is disposed. According to another aspect of the present invention, the non-planar surface of the base member is peaked and the plate portion includes a recess compatibly configured for mounting on the peaked surface of the base member.

According to another embodiment of the apparatus of the present invention, the post is conical in shape and tapers in the direction toward its free end with its largest diameter being greater than the inner diameter of the package tube, whereby the bottom of the package tube is supported on the post above the plate portion.

According to yet another aspect of the present invention, the apparatus further includes a yarn end engaging device positioned above the package in the cooperating member for engagement of a yarn end unwound from the package by the gas stream directing means.

According to yet a further embodiment of the apparatus of the present invention, the cooperating member tube includes a pair of relatively movable semi-cylindrical portions and means for moving the semi-cylindrical portions away from each other for positioning the package therebetween and for moving the semi-cylindrical portions toward one another to completely circumferentially surround the package.

According to another aspect of the apparatus of the present invention, the support means supports the package in non-contacting adjacent relation with the cooperating member after the yarn end has been unwound into position for subsequent package unwinding engagement and during subsequent package unwinding. According to one aspect of the present invention, the support means supports the package tube after yarn has been unwound therefrom and the support means is movable into a position between the relatively movable semi-cylindrical portions when they are moved away from one another for supporting the package, when the semi-cylindrical portions are moved toward one another, in contacting relation with the cooperating member for unwinding the yarn end. Additionally, the support means supports the package in non-contacting relation with the cooperating member after the yarn end has been unwound into position for subsequent package unwinding engagement and during subsequent package unwinding.

According to another aspect of the present invention, the cooperating member, the support means and the gas directing means are connected to a control means for controlling the respective operations thereof. The gas directing control means includes means for controlling the supply of gas to each jet nozzle to vary the characteristics of the spiraling stream of gas.

According to yet another embodiment of the apparatus of the present invention, the apparatus includes suction means including a suction nozzle mounted to the cooperating member for applying a suction to the package to remove debris generated during the planetary motion of the package. Preferably, the jet nozzles are selectively connectible with the suction means for applying suction through the jet nozzles to remove debris.

According to another aspect of the apparatus of the present invention, the jet nozzles are adjustably mounted to the cooperating member for adjusting the direction of the jet streams of gas.

DETAILED DESCRIPTION OF THE PREFERRED EMBODIMENTS

Figure 1:
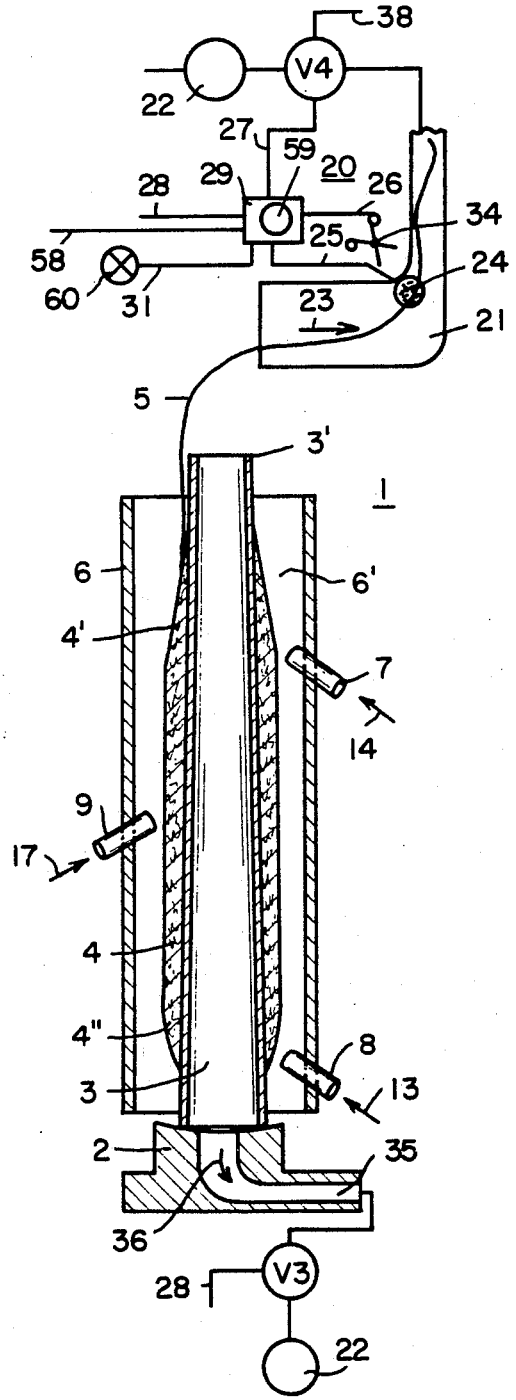
FIG. 1 is a front elevational view, in vertical section, of one preferred embodiment of the apparatus of the present invention, showing a package of the type having yarn wound on a tube being supported by the apparatus in non-contacting relation with the cooperating member of the apparatus.
Figure 2:
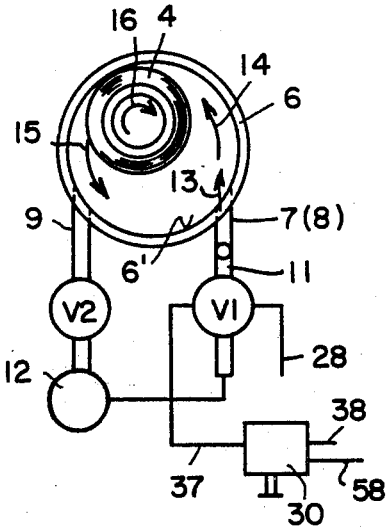
FIG. 2 is a top plan view of the portion of the apparatus shown in FIG. 1, showing the package moving in contact with the cooperating member of the apparatus in a planetary motion.

In FIGS. 1 and 2, one preferred embodiment of the method and apparatus of the present invention is illustrated. The yarn end unwinding apparatus 1 of the present invention includes a stationary support means 2 for supporting the tube 3 of a package 4 having yarn wound around the tube 3. The package 4 is of the type, for example, produced by a ring spinning machine and having a yarn end 5 capable of being positioned for subsequent package unwinding engagement. The yarn end unwinding apparatus 1 of the present invention positions the yarn end 5 in position for subsequent package unwinding engagement.

The yarn end unwinding apparatus 1 also includes a cooperating member 6 at least partially circumferentially surrounding the package 4 which is, for example, an open end tube having an inner surface 6'. The yarn end unwinding apparatus 1 further includes a means for moving the package 4, including means for directing a stream of gas in a spiraling direction relative to the package, for moving the package in contact with the cooperating member 6 in a planetary motion sufficient to unwind the yarn end. The gas directing means includes a plurality of jet nozzles 7,8 and 9 mounted in the cooperating member 6 for directing jet streams of gas interiorly of the cooperating member 6 in inclined tangential directions with respect to the package 4 toward an end of the package 4. The jet streams of gas combine together to form the spiraling stream of gas. The jet nozzle 7 opens interiorly of the cooperating member 6 at approximately the axial height of the upper end portion 4' of the package 4. The jet nozzle 8 opens interiorly of the cooperating member 6 at approximately the height of the lower portion 4'' of the package 4. As seen in FIG. 2, the jet nozzles 7 and 8 are both communicated by a conduit 11 with a source of pressurized gas 12 which can, for example, be a source of pressurized air. The conduit 11 has an adjustable valve V1 mounted therein for selectively controlling the supply of gas from the pressurized gas source 12 through the conduit 11 to the jet nozzles 7 and 8.

The jet nozzle 9 is communicated via a conduit with the pressurized gas source 12 and the supply of pressurized gas from the pressurized gas source 12 to the jet nozzle 9 is selectively controlled by a valve V2 mounted in the conduit.

The support means 2 has a concave support surface on which the lower axial end of the tube 3 is supported. A suction conduit 35 extends from the base of the concave surface to a suction means 22 for applying a suction through the tube 3. The conduit 35 has a valve V3 mounted therein for selectively controlling the application of the suction through the tube 3 by the suction means 22.

The yarn end package unwinding apparatus 1 further includes a yarn end engaging device 20 positioned above the package 4 and the cooperating member 6 for engagement of the yarn end 5 unwound from the package 4 by the package moving means. The yarn end engaging device 20 includes a suction tube 21 communicated via a conduit with the suction means 22. A valve V4 mounted in the conduit between the suction tube 21 and the suction means 22 selectively controls the application of suction through the suction tube 21. The yarn end engaging device 20 further includes a control means 29 for controlling the operation of the yarn end engaging device 20, the suction means 22 and the pressurized gas source 12. The control means 29 is connected via a connector 27 to the valve V4 and via a connector 28 to the valve V1 and the valve V3. The control means 29 is connected via connector 25 to a sensor 24 positioned in the suction tube 21 for sensing the presence of the yarn end 5 suctioned therein. Additionally, the control means 29 is connected via a connector 26 to a conventional yarn cutting device 34.

The yarn end unwinding apparatus 1 additionally includes a control means 30 connected via connector 37 to the valve V1, via a connector 38 to the valve V4 and via a connector 58 to the control means 29. In operation, the package 4 is disposed in an upright disposition on the support means 2 with the tube 3 of the package 4 in communication with the suction conduit 35. The cooperating member 6 completely circumferentially surrounds the package 4 and the jet nozzles 7,8 and 9 are positioned to direct jet streams of gas interiorly of the cooperating member 6 in inclined tangential directions with respect to the package 4 toward the end 3' of the tube 3. To unwind the yarn end 5, the valve V1 is operated either manually or through the operation of the control means 30 to permit pressurized gas to be supplied from the pressurized gas source 12 through the conduits 11 to the jet nozzles 7 and 8. The pressurized gas exits the jet nozzles 7 and 8 as a plurality of jet streams of gas 13, as best seen in FIG. 2, which combine together to form a stream of gas 14 in a spiraling direction relative to the package 4. The spiraling stream of gas 14 urges the package 4 to move in contact with the cooperating member in orbital movement along the surface 6' of the cooperating member 6 in the direction indicated by the arrow is. The movement of the package 4 relative to the cooperating member 6 along the inner surface 6' thereof causes the package 4 to rotate about its axis in the direction indicated by the arrow 16 while the package is moving relative to the cooperating member. Accordingly, the spiraling stream of gas 14 causes planetary movement of the package 4 in which the orbital movement thereof is in the direction indicated by the arrow 15 and the axial rotation of the package about its axis is indicated by the arrow 16.

The planetary motion of the package 4 causes the yarn end 5 to unwind therefrom and the upwardly spiraling stream of gas 14 urges the yarn end 5 upwardly out of the cooperating member 6. The control means 29 actuates the valve V4 via the connector 27 to permit a suction to be applied through the suction tube 21 by the suction means 22. If desired, the control means 29 can be adjusted to open the valve V4 substantially simultaneously with the opening of the valve V1. Accordingly, as the yarn end 5 is urged upwardly out of the cooperating member 6, the suction tube 21 applies a suction to the yarn end to draw the yarn end inwardly thereof in the direction indicated by the arrow 23 in FIG. 1. Eventually, the yarn end 5 is sufficiently drawn into the suction tube 21 to contact the sensor 24 which, via the connector 25, signals the control means 29 concerning the presence of the yarn end 5 in the suction tube 21.

When the control means 29 receives the signal from the sensor 24 concerning the presence of the yarn end 5 in the suction tube 21, the control means closes the valve V1 and opens the valve V3, via the connector 28. The opening of the valve V3 permits a suction to be applied through the suction conduit 35 by the suction means 22. Simultaneously, the control means 29 actuates the yarn cutting device 34 via the connector 26 to cut the yarn end 5 and, thereafter, closes the valve V4 via the connector 27 to stop the application of the suction through the suction tube 21, whereupon the suction being applied through the suction conduit 35 causes the yarn end 5 to be drawn inwardly into the tube 3 of the package 4. Thus, the yarn unwinding apparatus 1 of the present invention positions the yarn end 5 in the package 4 in position for subsequent package unwinding engagement. The control means 29 close the valve V3 after a predetermined time and the package 4 is thereafter removed from the cooperating member 6, whereupon another package can be positioned in the cooperating member for unwinding of a yarn end therefrom in an identical manner. The package 4 can be removed, for example, by lifting the package out of the cooperating member 6 or displacing the support means 2 to allow the package 4 to drop out of the cooperating member 6.

In the event that the package 4 is wound in an opposite direction, the above-described winding operation can be similarly executed to unwind a yarn end therefrom with the exception that, instead of the directing of jet streams of gas by the jet nozzles 7 and 8, the stream of gas is directed through the jet nozzle 9. As seen in FIG. 2, the jet nozzle 9 directs a jet stream of gas in a direction opposite to the jet streams of gas directed by the jet nozzle 7 and 8. Accordingly, the package 4 is caused to move relative to the cooperating member 6 in a direction opposite to the direction indicated by the arrow 15 when a jet stream of gas is directed relative thereto by the jet nozzle 9. Additionally, the package 4 is caused to rotate about its axis in a direction opposite to the direction by the arrow 16 and the resulting planetary motion of the package 4 causes unwinding of a yarn end therefrom for positioning in a position for subsequent package unwinding engagement.

The present invention also contemplates that the cooperating member 6 can be provided with a pair of sets of three jet nozzles each, with each set of jet nozzles directing jet streams of gas in a respective clockwise or counterclockwise direction within the cooperating member 6 with one jet nozzle of each set being oriented to direct a jet stream of gas upwardly tangentially to the upper winding portion 4', another jet nozzle being oriented to direct a jet stream of gas upwardly tangentially to the middle portion of the package 4 and the third jet nozzle being oriented to direct a jet stream of gas upwardly tangentially to the lower yarn portion 4''. Additionally, the present invention contemplates that the jet nozzles can be mounted in the cooperating member 6 at locations axially and circumferentially spaced from one another. The jet nozzles 7 and 8 in the embodiment shown in FIGS. 1 and 2 are circumferentially aligned with, and axially displaced from, each other. The inner diameter of the jet nozzles 7,8 and 9, which can be formed of conventional small tubes, is approximately in the range of one millimeter to ten millimeters.

The jet nozzles 7,8 and 9 are advantageously oriented to direct their respective jet streams of gas tangentially to the package 4 as opposed to directing their jet streams of gas directly—i.e., radially—against the package 4 with the thereby attendant yarn damage which would occur. However, if desired, jet nozzles can be mounted in the cooperating member 6 to direct jet streams of gas directly against the package 4 in the lower yarn portion 4'' to facilitate the unwinding of yarn ends wound thereon.

Figure 3:
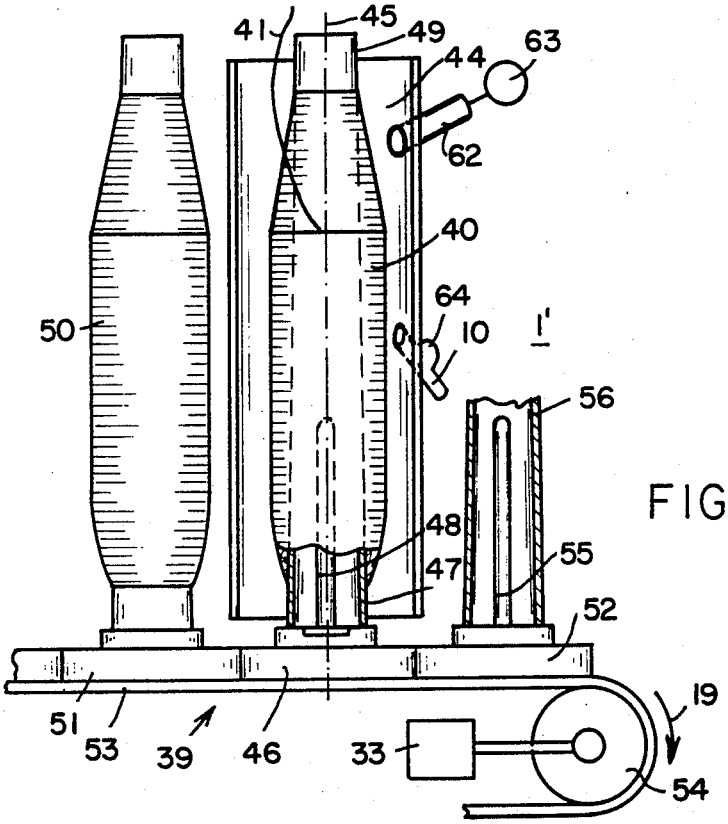
FIG. 3 is front elevational view of a portion of another preferred embodiment of the apparatus of the present invention, showing a package being supported in non-contacting adjacent relation with the cooperating member of the apparatus.
Figure 4:
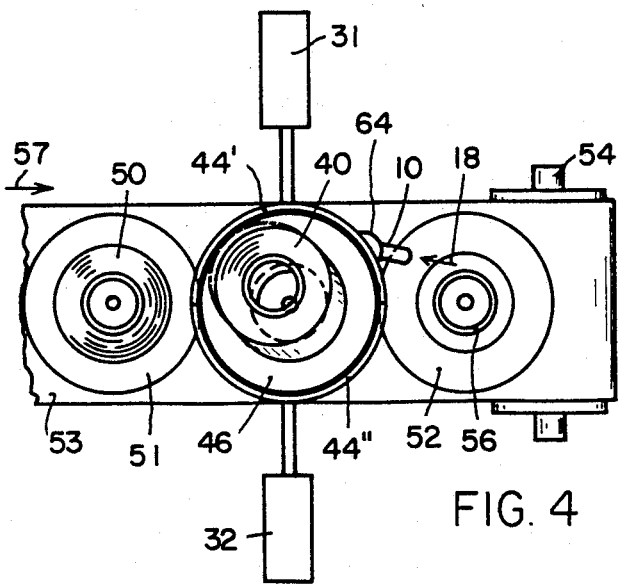
FIG. 4 is a top view of the apparatus shown in FIG. 3, showing a portion of the cooperating member in position for completely circumferentially surrounding the package during planetary motion of the package.

In FIGS. 3 and 4, a second preferred embodiment of the yarn unwinding apparatus of the present invention is illustrated and generally designated as 1'. In this embodiment, the yarn unwinding apparatus 1' is positioned at an unwinding station 39 of an unwinding machine and the yarn unwinding apparatus includes a yarn end engagement device similar to the yarn end engagement device 20 illustrated in FIG. 1. The yarn end unwinding apparatus 1' is operable to unwind a yarn end 41 from a package 40 into position for engagement of the yarn end by the unwinding machine for subsequent unwinding of the package 40 at the unwinding station 39. The yarn end unwinding apparatus 1' includes a cooperating member 44 which completely circumferentially surrounds the package 40 disposed therein. The cooperating member 44 is generally cylindrical and supported in centered relation on a vertical axis 45. The package 40 is disposed coaxially on the axis 45. The cooperating member 44 is provided with a plurality of jet nozzles 10, only one of which is illustrated, mounted thereon for directing jet streams of gas upwardly tangentially with respect to the package 40. The jet nozzle 10 is formed with a semi-cylindrical projection 64 which is pivotally mounted to the cooperating member 44 to permit adjustment of the orientation of the jet nozzle 10 with respect to the cooperating member 44, whereby the direction of the jet stream of gas exiting the jet nozzle 10 can be adjusted. The yarn end unwinding apparatus 1' additionally includes a support means 46 having a plate portion engageable by a transport device for transport thereby and a post 48 extending from the plate portion for package supporting insertion in the package tube 47 of the package 40. In FIGS. 3 and 4, the support means 46 supports the package 40 in non-contacting adjacent relation with the cooperating member 44 after the yarn end 41 has been unwound into position for subsequent package unwinding engagement and during subsequent package unwinding by the unwinding station 39.

As best seen in FIG. 4, the cooperating member 44 includes a pair of relatively movable semi-cylindrical portions 44',44'' and a means for moving the semi-cylindrical portions 44',44'' relative to one another. The moving means includes a pneumatic piston and cylinder assembly 31 having its piston fixedly connected to the semi-cylindrical portion 44' and a pneumatic piston and cylinder assembly 32 having its piston fixedly connected to the semi-cylindrical portion 44''. The pneumatic piston and cylinder assemblies 31,32 are operable to move the semi-cylindrical portions 44',44'' away from one another for positioning the package 40 therebetween and for moving the semi-cylindrical portions toward one another to completely circumferentially surround the package 40. As seen in FIG. 4, the pneumatic piston and cylinder assemblies 31,32 are positioned relative to the transport device of the unwinding machine such that packages to be unwound can be sequentially positioned between the withdrawn semi-cylindrical portions 44',44'' by movement of a conveyor belt 53 of the transport device. The conveyor belt 53 supports the support means 46, a support means 52 which supports the tube 56 of a package which has previously been unwound by the yarn end unwinding apparatus 1', and a support means 51 which supports a package 50 to be sequentially positioned in the yarn end unwinding apparatus 1 following the unwinding of the package 40. As seen in FIG. 3, the conveyor belt 53 of the transport device of the unwinding machine is trained around a drive roller 54 having an integral drive motor which is controlled by a control means 33.

The yarn end unwinding apparatus 1' additionally includes a suction nozzle 62 mounted in the cooperating member 44 and connected to a suction means 63.

The preferred embodiment of the apparatus of the present invention illustrated in FIGS. 3 and 4 operates as follows. A plurality of packages, such as the packages 40 and 50, are positioned in side-by-side relation on the conveyor belt 53 and supported in upright dispositions by their respective support means, such as the support means 46,51. The conveyor belt 53 is advanced under the control of the control means 33 in the direction of the arrow 57 shown in FIG. 4 to sequentially position the packages in the yarn end unwinding apparatus 1' for unwinding a yarn end therefrom in position for subsequent package unwinding engagement at the unwinding station 39. The pneumatic piston and cylinder assemblies 31,32 are operated to move the semi-cylindrical portions 44',44" away from one another for positioning a package for yarn end unwinding. The conveyor belt 53 is moved in the direction of the arrow 57 to position a package for unwinding, such as the package 40, between the withdrawn semi-cylindrical portions 44',44". Thereafter, the pneumatic piston and cylinder assemblies 31,32 are operated to move the semi-cylindrical portions 44',44" toward one another to completely circumferentially surround the package 40.

A jet stream of gas is then introduced through the jet nozzle 10 in a direction upwardly tangential with respect to the package 40 (indicated by the arrow 18 in FIG. 4) to cause planetary motion of the package to effect unwinding of the yarn end 41 in position for subsequent package unwinding engagement. Thereafter, the unwinding station 39 unwinds the package 40 in conventional manner. The pneumatic piston and cylinder assemblies 31,32 are then operated to move the semi-cylindrical 44',44" away from one another and the conveyor belt 53 is advanced to move the now empty tube 47 of the package 40 in the advancing direction of the conveyor belt. In FIG. 3, the tube 56 supported on the post 55 of the support means 52 illustrates an empty tube of a package which has just been unwound at the unwinding station 39. The movement of the conveyor belt 53 additionally acts to bring the package 50 into position between the semi-cylindrical portions 44',44" for yarn end unwinding by the yarn end unwinding apparatus 1' during its next cycle of operation. In this manner, the yarn end unwinding apparatus 1' is operable to position the yarn ends of a plurality of packages for subsequent package unwinding engagement by the unwinding station 39 of the unwinding machine.

The empty tubes, such as the empty tube 56, are eventually discharged by the conveyor belt 53 in the direction indicated by the arrow 19 in FIG. 3 to a device for further handling the empty tubes.

In the event that the yarn end of the package positioned between the semi-cylindrical portions 44',44" is not successfully positioned in position for subsequent yarn package unwinding by the operation of the yarn end unwinding apparatus 1' through one cycle, the apparatus can be operated through another cycle to again attempt to unwind the yarn end from the package. In this regard, a control apparatus, such as, for example, the control apparatus 29 shown in FIG. 1, can be adjusted to close the valves controlling the supply of the jet streams of gas to the jet nozzles if the sensor 24 does not detect the presence of a yarn end in the suction tube 21 after a predetermined time. Thereafter, after a predetermined time, the control means 29 can control the operation of the valves to again cause planetary motion of the package. Accordingly, the control means 29 can be programmed to operate the yarn end unwinding apparatus through a predetermined number of cycles and, if no yarn end has been positioned after the execution of the predetermined number of cycles, the control means 29 can close the respective valves and indicate its status, such as, for example, by illuminating a disturbance indicator lamp 60 connected thereto by a connector 31, as shown in FIG. 1.

The present invention also contemplates that the post 48 extending from the plate portion of the support means 46 can be configured to be radially enlargeable, such as by a wedging member, to enhance the package supporting action of the post during unwinding of the package.

In addition to repeating the cycles of operation of the yarn end unwinding apparatus in the event that a yarn end is not initially successfully positioned for subsequent package unwinding engagement, the apparatus can be controlled to vary the characteristic of the jet streams of gas introduced by the jet nozzles. For example, the jet streams of air can be controlled to be introduced intermittently.

During the yarn end unwinding operation, the dust and other debris which develops during the planetary movement of the package within the cooperating member 44 are removed by the application of suction through the suction nozzle 62 by the suction means 63. Alternatively, after the yarn end 41 has been positioned by the yarn end unwinding apparatus 1' in position for subsequent package unwinding engagement, the pneumatic piston and cylinder assemblies 31,32 can be operated to move the semi-cylindrical portions 44',44" slightly away from one another so that the suction means 63 draws clean air through the open spacing between the separated semi-cylindrical portions 44',44" to facilitate removal of the debris thereby.

The adjustability of the jet nozzle 10 allows the jet nozzle to be optimally adjusted for introducing a jet stream of gas advantageously in correspondence with the winding direction of the package to effect efficient unwinding of a yarn end therefrom.

The present invention also contemplates that the cooperating member 44 can be conical in shape tapering inwardly with respect to the axis of the package 40 in the direction from the top to the bottom of the package.

Figure 5:
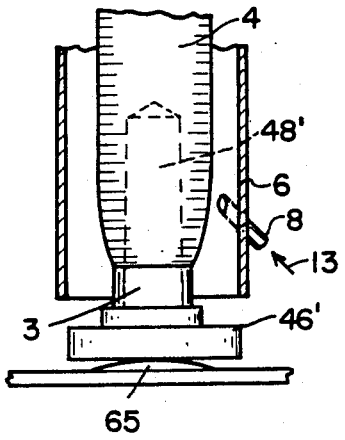
FIG. 5 is a partial front elevational view, in partial section, of yet another embodiment of the apparatus of the present invention, showing a package being supported on the support means of the apparatus.

In FIG. 5, another preferred embodiment of the yarn end unwinding apparatus of the present invention is illustrated and is similar to the apparatus illustrated in FIGS. 1 and 2 except that the support means includes a plate portion 46', a post 48' extending from the plate portion 46' and a base member 65 having a non-planar, convex surface. The plate portion 46' is disposed on the non-planar surface of the base member 65 for relative movement thereon whereby the relative movement of the plate portion 46' and the non-planar surface permits orbital movement of the package 4 during its planetary motion.

Figure 6:
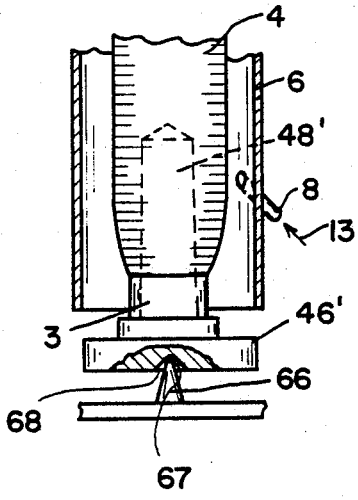
FIG. 6 is a partial front elevational view, in partial section, of yet a further embodiment of the apparatus of the present invention.

In FIG. 6, yet another embodiment of the apparatus of the present invention is illustrated which is similar to the embodiment illustrated in FIGS. 1 and 2 except that the support means includes a plate portion 46', a post 48' extending from the plate portion 46' and a base member 66 having a non-planar surface 67. The non-planar surface 67 of the base member 66 is peaked and the plate portion 46' includes a recess 68 compatibly configured for mounting on the peaked non-planar surface 67 of the base member 66, whereby the relative movement of the plate portion 46' and the non-planar surface 67 permits planetary movement of the package.

Figure 7:
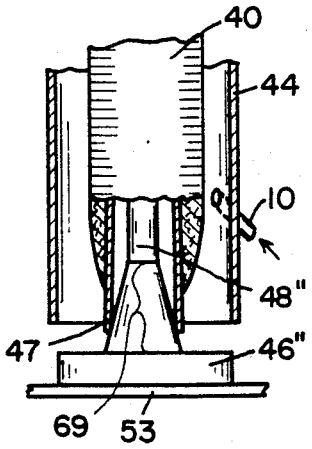
FIG. 7 is a partial front elevational view, in partial section, of another embodiment of the apparatus of the present invention.

In FIG. 7, a further embodiment of the yarn end unwinding apparatus of the present invention is illustrated and is similar to the embodiment illustrated in FIGS. 3 and 4 except that the support means includes a plate portion 46", a frusto-conical portion 69 extending from the plate portion 46" and a cylindrical post portion 48" extending from the frusto-conical portion 69. The frusto-conical portion 69 tapers in the direction toward the free end of the post 47 with the largest diameter of the portion being greater than the inner diameter of the package tube 47 of the package 40, whereby the bottom of the package tube 47 is supported on the frusto-conical portion 69 above the plate portion 46".

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method of unwinding a yarn end of a yarn package, the yarn package being of the type having yarn wound on a tube and having an axis, comprising:

supporting the package in contact with a cooperating member, said cooperating member at least partially circumferentially surrounding the package and the package being supported to permit rotation about its axis; and moving the package in contact with said cooperating member in a planetary motion while directing a stream of gas in a spiraling direction relative to the package during the planetary motion of the package, thereby unwinding the yarn end from the package into position for subsequent unwinding engagement.

2. A method according to claim 1 and characterized further by causing orbital movement of the package by said stream of gas during its planetary motion.

3. A method according to claim 1 and characterized further by causing axial rotation of the package by said stream of gas during its planetary motion.

4. A method according to claim 1 and characterized further by causing said planetary motion of the package by said stream of gas.

5. A method according to claim 1 and characterized further by disposing the unwound yarn end in the package tube on which the package is supported.

6. A method according to claim 1 and characterized further by supporting the package in non-contacting adjacent relation to said cooperating member after the yarn end has been unwound into said position for subsequent package unwinding engagement and during subsequent package unwinding.

7. A method according to claim 6 and characterized further by, in the event of a yarn break present after said non-contacting supporting, further supporting the package in contact with said cooperating member and moving the package in contact with said cooperating member in a planetary motion to position another yarn end for subsequent package unwinding engagement.

8. A method according to claim 1 and characterized further by, in the event of a yarn break during said unwinding of the yarn end into position for subsequent package unwinding engagement, further moving the package in contact with said cooperating member in a planetary motion while directing a stream of gas in a spiraling direction relative to the package during the planetary motion of the package to thereby further unwind the yarn end from the package into position for subsequent package unwinding engagement.

9. A method according to claim 1 and characterized further by applying a suction through the tube to draw the yarn end into the tube in position therein for subsequent package unwinding engagement.

10. A method according to claim 9 and characterized further by, in the event of a yarn break during said unwinding of the yarn into position for subsequent package unwinding engagement, further moving the package in contact with said cooperating member in a planetary motion while directing a stream of gas in a spiraling direction relative to the package during the planetary motion of the package and applying further suction through the tube to thereby further unwind the yarn end from the package into a position in the tube for subsequent package unwinding engagement.

11. An apparatus for unwinding a yarn end of a yarn package, the yarn package being of the type having yarn wound on a tube and having an axis, comprising:

a cooperating member at least partially circumferentially surrounding the package;

support means for supporting the package in contact with said cooperating member, said support means permitting the package to rotate about its axis; and means for moving the package in contact with said cooperating member in a planetary motion, said moving means including means for directing a stream of gas in a spiraling direction relative to the package sufficient to unwind the yarn end, whereby the yarn end is unwound from the package into position for subsequent package unwinding engagement.

12. An apparatus according to claim 11 and characterized further in that said gas directing means comprises means for causing orbital movement of the package during its planetary motion.

13. An apparatus according to claim 11 and characterized further in that said gas directing means comprises means for causing axial rotation of the package during its planetary motion.

14. An apparatus according to claim 11 and characterized further in that said gas directing means comprises means for causing orbital movement and axial rotation of the package during its planetary motion.

15. An apparatus according to claim 11 and characterized further in that said cooperating member includes a tube which completely surrounds the package.

16. An apparatus according to claim 11 and characterized further in that said support means includes means for supporting the package in non-contacting adjacent relation to said cooperating member after the yarn end has been unwound into said position for subsequent package unwinding engagement and during subsequent package unwinding.

17. An apparatus according to claim 11 and characterized further by means for applying a suction through the package tube to draw the yarn end into the package tube.

18. An apparatus according to claim 11 and characterized further in that said gas directing means includes a plurality of jet nozzles mounted in said cooperating member for directing jet streams of gas interiorly of said cooperating member in inclined tangential directions with respect to the package toward an end of the package, whereby said jet streams of gas combine together to form said spiraling stream of gas.

19. An apparatus according to claim 18 and characterized further in that said support means yieldably supports said package in a generally vertical disposition in non-contacting relation to said cooperating member while allowing the package to be moved into cooperating member contact by said gas directing means with the package tube being aligned along a vertical axis, said cooperating member being disposed generally coaxial with the vertical axis of the package and said jet nozzles extending inwardly of said cooperating member at upward inclinations.

20. An apparatus according to claim 19 and characterized further in that said cooperating member is a tube which completely circumferentially surrounds the package.

21. An apparatus according to claim 20 and characterized further in that said cooperating member tube includes a pair of relatively movable semi-cylindrical portions and means for moving said semi-cylindrical portions away from each other for positioning the package therebetween and for moving said semi-cylindrical portions toward one another to completely circumferentially surround the package.

22. An apparatus according to claim 21 and characterized further in that said support means supports the package in non-contacting adjacent relation with said cooperating member after the yarn end has been unwound into position for subsequent package unwinding engagement and during subsequent package unwinding, said support means being movable into a position between said relatively movable semi-cylindrical portions when they are moved away from one another for supporting the package, when said semi-cylindrical portions are moved toward one another, in contacting relation with said cooperating member for unwinding the yarn end.

23. An apparatus according to claim 22 and characterized further by control means connected to said cooperating member, said support means and said gas directing means for controlling the respective operations thereof.

24. An apparatus according to claim 18 and characterized further in that said gas directing means includes means for controlling the supply of gas to each said jet nozzle to vary the characteristics of said stream of gas.

25. An apparatus according to claim 18 and characterized further by suction means including a suction nozzle mounted to said cooperating member for applying a suction to the package to remove debris generated during the planetary motion of the package and in that said jet nozzles are selectively connectible with said suction means for applying suction therethrough to remove debris.

26. An apparatus according to claim 18 and characterized further by means for adjustably mounting said jet nozzles to said cooperating member for adjusting the direction of said jet streams of gas.

27. An apparatus according to claim 11 and characterized further in that said cooperating member is cylindrical in shape.

28. An apparatus according to claim 11 and characterized further in that said cooperating member is conical in shape.

29. An apparatus according to claim 28 and characterized further in that said cooperating member tapers inwardly with respect to the axis of the package in the direction from the top to the bottom of the package.

30. An apparatus according to claim 11 and characterized further in that said support means includes a plate portion engageable by a transport device for transport thereby and a post extending from said plate portion for package supporting insertion in the package tube.

31. An apparatus according to claim 30 and characterized further in that said support means includes a base member having a non-planar surface and said plate portion is disposed on said non-planar surface for relative movement thereon, whereby the relative movement of said plate portion and said non-planar surface permits planetary motion of the package.

32. An apparatus according to claim 31 and characterized further in that said non-planar surface of said base member is a convex surface on which said plate portion is disposed.

33. An apparatus according to claim 31 and characterized further in that said non-planar surface of said base member is peaked.

34. An apparatus according to claim 33 and characterized further in that said plate portion includes a recess compatibly configured for mounting on said peaked surface of said base member.

35. An apparatus according to claim 30 and characterized further in that said post is conical in shape and tapers in the direction toward its free end with its largest diameter being greater than the inner diameter of the package tube, whereby the bottom of the package tube is supported on said post above said plate portion.

36. An apparatus according to claim 35 and characterized further in that said support means includes means for supporting the package in non-contacting adjacent relation with said cooperating member after the yarn end has been unwound into position for subsequent package unwinding engagement and during subsequent package unwinding.

37. An apparatus according to claim 11 and characterized further by a yarn end engaging device positioned above the package in said cooperating member for engagement of a yarn end unwound from the package by said gas stream directing means.

38. An apparatus according to claim 11 and characterized further by suction means including a suction nozzle mounted to said cooperating member for applying a suction to the package to remove debris generated during the planetary motion of the package.

* * * * *